US005081817A

United States Patent [19]

Nesbitt

[11] Patent Number: 5,081,817

[45] Date of Patent: Jan. 21, 1992

[54] CARTON HANDLE APPARATUS

[76] Inventor: Alexander Nesbitt, 5 Farnsworth Drive, Weston, Ont., Canada, M9N 2Z5

[21] Appl. No.: 180,790

[22] Filed: Apr. 12, 1988

[30] Foreign Application Priority Data

Aug. 20, 1987 [CA] Canada ..... 545020

[51] Int. Cl.[5] ..... B65B 61/14

[52] U.S. Cl. ..... 53/134.1; 53/389.3; 53/361; 53/486; 53/522

[58] Field of Search ..... 53/134, 137, 413, 415, 53/134.1, 136.1, 136.4, 389.3; 156/353, 361, 486, 489, 510, 516, 517-521, 522, 552, 566

[56] References Cited

U.S. PATENT DOCUMENTS

| | | | |
|---|---|---|---|
| 3,045,402 | 7/1962 | Keely et al. . | |
| 3,196,591 | 7/1965 | Guido et al. . | |
| 3,199,262 | 8/1965 | Miller et al. . | |
| 3,437,544 | 4/1969 | Wilcox | 53/134 |
| 3,455,082 | 7/1969 | Feigel . | |
| 3,466,843 | 9/1969 | Mumper . | |
| 3,557,516 | 1/1971 | Brandt | 53/134 X |
| 4,294,058 | 10/1981 | Rensner | 53/413 |
| 4,415,399 | 11/1983 | Geisinger | 156/486 X |
| 4,700,528 | 10/1987 | Bernard | 53/413 X |
| 4,716,707 | 1/1988 | Gambetti | 53/134 |
| 4,758,301 | 7/1988 | Inoko et al. | 156/521 X |

FOREIGN PATENT DOCUMENTS

| | | | |
|---|---|---|---|
| 8704967 | 7/1987 | Fed. Rep. of Germany . | |
| 2596701 | 10/1987 | France | 53/134.1 |
| 0231597 | 8/1987 | United Kingdom | 53/413 |

*Primary Examiner*—John Sipos
*Attorney, Agent, or Firm*—Nixon & Vanderhye

[57] ABSTRACT

A handle taping system provides a mechanism for a taping station that is actuated by the passage of any of a variety of articles or products being conveyed therepast. A length of a first pressure sensitive carrier tape, whose length is automatically determined in accordance with the length of the article is applied in adhering relation to the leading face of the article and the tape drawn lengthwise from the reel by passage of the article therealong. A second, blanking ribbon is released in adhering relation with the first tape, having the pressure sensitive adherent face of the tape pressed in securing relation with the ribbon, to form a handle portion. As the article trailing end passes a first limit switch the blanking ribbon is automatically severed, thus limiting the length of the blanked handle portion of the first tape to a desired length relative to the length of the article. Subsequent passage of the article trailing end past a second switch reattaches the ribbon to the first tape, thus leaving a residual, unmasked intermediate attachment portion of first tape, which portion is automatically divided to provide a trailing end tab, and a leading end attachment tab for the succeeding article's handle. The trailing end tab is adhered to the article, generally down the trailing end face of the article, to thereby fix the handle in securely attached relation. In another embodiment, blanking of the handle outer face is provided by the application of an inert filler or deactivating fluid or thereto as an adhesive suppressant.

12 Claims, 5 Drawing Sheets

FIG.1.
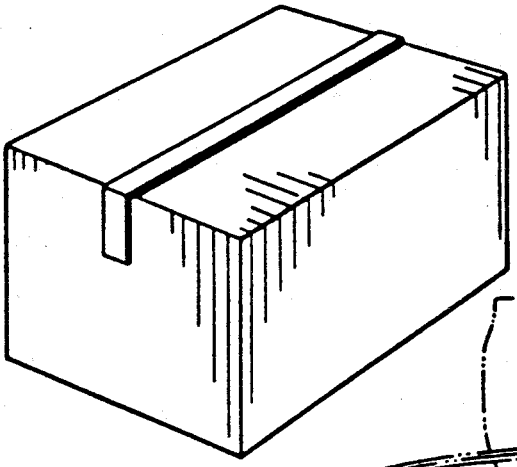
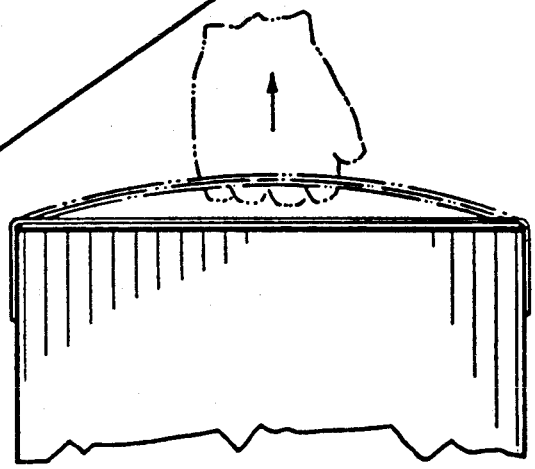
FIG.2.
FIG.3.
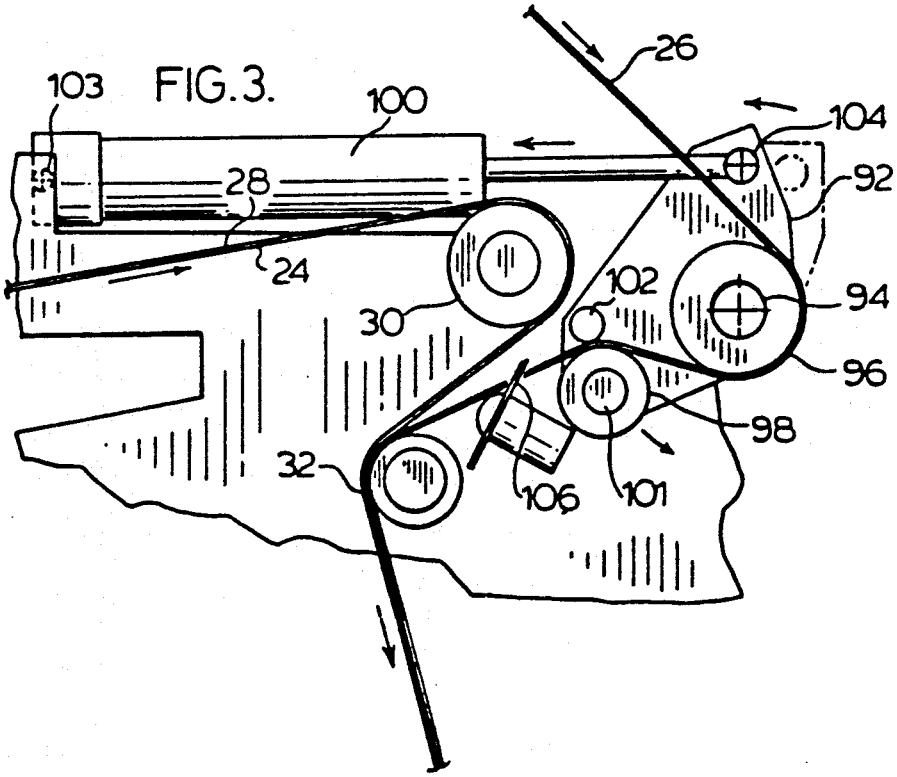

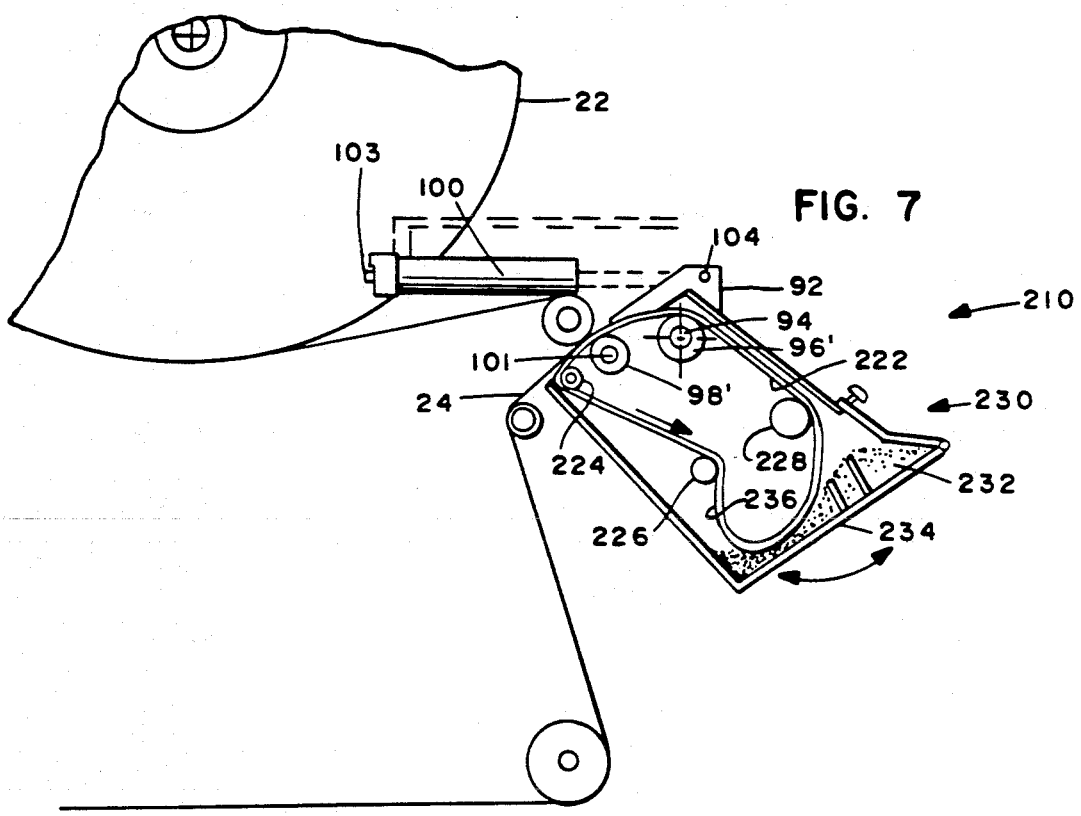
FIG. 7
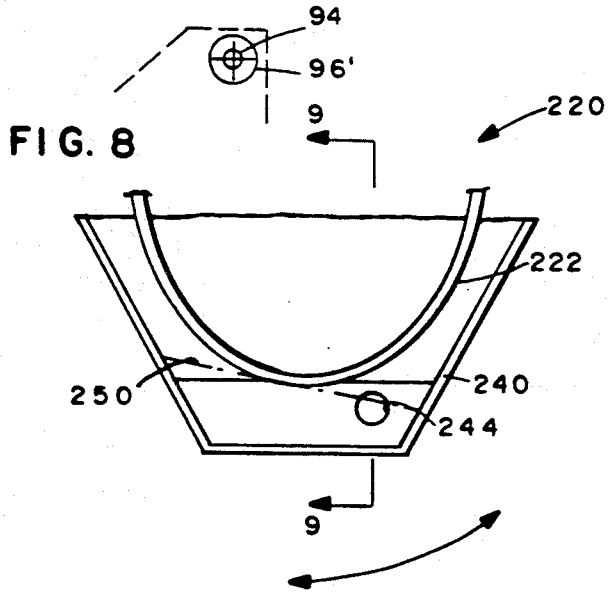
FIG. 8
FIG. 9
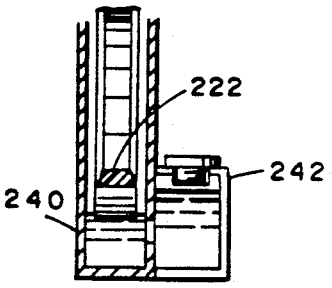

CARTON HANDLE APPARATUS

BACKGROUND OF THE INVENTION

This invention is directed to a handle taping system for forming an article handle adhered by tape, and for automatically applying the handle so formed to a variety of products or articles.

In the merchandizing of prepackaged goods one of the problems, particularly where the package is of a size not readily accomodated in a standard kraft paper sack or plastic shopping bag, is assuring the convenience of the purchaser in safe handling of an awkward sized package. In the case of boxes, one approach is to provide knock-out hand holds in the sides of the box or package for insertion of the user's figers within the package. Another approach is the provision of an injection molded or extruded plastic handle, which is secured in a semi-inserted fashion into the structure of the package, at considerable expense and incovenience. The presence of such handles in the case of regular boxes impedes the free palletizing of the packages in-bulk, and interferes with the stability of a free-standing display pile of such packages, a presently favoured form of mass marketing. In general the cost of providing handles adds significantly to packaging costs.

Yet earlier and more primitive, labour intensive arrangements devolved about the use of string, with or without detachable handles.

The following listed U.S. Pats. No. are believed relevant:

U.S. Pat. No. 3,834,970 MITSUOKA et al Sept. 1974,
U.S. Pat. No. 3,915,786 COLLETT et al Oct. 1975,
U.S. Pat. No. 3,800,679 BARTELMEIMER Apr. 1974,
U.S. Pat. No. 4,027,578 VARGA et al Jun. 1977,
U.S. Pat. No. 4,227,955 WOODS et al Oct. 1980, and
U.S. Pat. No. 4,592,188 MARCHETTI Jun. 1986.

SUMMARY OF THE INVENTION

The present invention provides a system for the automatic attachment of carrying handles to various products in a range of shapes and sizes and possible random sequence, without making any intervening adjustment to the handle applying apparatus. The apparatus applies the required length of adherent tape, in accordance with the individual length of the product to which that specific handle is to be applied, and dispenses the corresponding, but different quantity of masking tape or element or an adhesive suppressant for the respective product, and brings the tape and the masking element into mutual adhering relation and laid along the surface of the product, and adheres the leading and trailing handle ends to the respective, specific product for which that handle was made.

The subject apparatus can thus make and secure succeeding handles for succeeding random products of differing shapes and sizes.

In accordance with the present invention there is provided a handle system wherein individual articles or products are provided with a taped-on handle having adhesive end tabs attached to the product, and an intermediate non-adherent handle portion extended between the end tabs.

In one embodiment of the system, the handle portion extends for and is comformed precisely to the length of the individual product, as sensed by actuating elements of the handle applying mechanism. In the case of a right rectangular body, such as a package product, this comformed dimension is represented by the top face of the product, along which the comformed handle is secured.

In a second embodiment the length of the handle portion is adjustable, and can be made shorter or longer than the length of the product.

In this embodiment there is further provided a loop positioning means, for positioning the free loop of the handle in predetermined relation with the top of the product, to facilitate subsequent handling thereof.

In the preferred embodiment of the looped handle system, the free loop is positioned at the front of the subject product.

The present invention further provides a method of securing a carrying handle in attached relation to a product, comprising the steps of: dispensing a length of tape on to a product, having the length thereof selected in response to the length of the product; adherably securing first and third portions of the tape to spaced first and third surfaces of the product, and overlaying a second, intermediate portion of the tape over a second surface of the package located intermediate the first and third product surfaces, the second tape portion comprising the handle.

More particularly, the system provides a tape dispensing apparatus for dispensing a length of tape on to a product, first and third portions of the tape being adherably securable to first and third surfaces of the product; a second intermediate portion of the tape overlying a second surface of the product intermediate the first and third surfaces of the product in non-adhering, handle forming relation therewith.

The apparatus thus includes first attaching means for attaching a first tab portion of the dispensed tape in adherent relation with a predetermined first portion of the product; blanking element or adhesive suppressant dispensing means for dispensing a blanking ribbon element or adhesive suppressant in masking relation with the second length of the dispensed tape; first severing means to sever the blanking ribbon portion from the second dispensing means in accordance with the length of the product; second severing means to sever the selected length of the tape, being in excess of the length of the blanking ribbon element or the length of adhesive suppressed tape, and second attaching means for attaching the third portion of the tape in adhered relation with the third portion of the product.

A particular advantage of the preferred embodiments of the present system is that the apparatus is actuated by the passage of the product, so that a handle extending the precise length of the top of the product, or of a lesser or greater extent can be provided, regardless of the respective length of the package involved.

Thus, operation of the system with packages of random dimension does not require changes in set-up or any adjustment thereto.

A further advantage is the provision of a strong, dual thickness handle where required, that is laterably flexible to the hand of a user, but readily conforms with the top of a product to which it is applied to minimize interference in bulk handling thereof.

The apparatus in accordance with the present invention may be hand portable and readily utilized in cooperation with a product transporting system.

The subject handle thus provided has a certain degree of longitudinal elasticity, to permit conformity with the top surface of the subject product, to which it is adhered. It also permits ready insertion of the users hand beneath the handle. While in general use a plain blanking element is used, in one handle embodiment the blanking ribbon comprises a pressure sensitive tape, having the adhesive face thereof in facing relation with the adhesive portion of the handle attachment tape.

In a further embodiment the blanking element comprises an adhesive suppressant layer that is selectively applied to the tape to suppress the adhesion thereof over that portion of the adherent face of the dispensed tape.

The tension of the first tape is controlled by an adjustable friction plate bearing as a brake against the hub of the tape reel.

In accordance with the system second embodiment, the subject looped handle applying device possesses the same characteristics of light weight, portability and capability of use in cooperation with a product transporting system.

However, the length of the handle portion is adjustable, and can be made a predetermined amount longer or shorter than the top of the product.

In general the somewhat longer looped handle is the preferred usage, wherein a free loop is formed, which, in the preferred embodiment, is positioned at or adjacent the front face of the product, to facilitate organization thereof, and so a not to impede attachment of the trailing end adhesive tab by which the handle is secured.

BRIEF DESCRIPTION OF THE DRAWINGS

While the subject system is useful with products of varied size and shape, illustration is made in relation to a box-like product.

Certain embodiments of the invention are described, reference being made to the accompanying drawings, wherein:

FIG. 1 is a general view of a product having the subject first, conformed handle embodiment secured thereto;

FIG. 2 is a side elevation of a portion of the product of FIG. 1, illustrating the manner of use of the conformed handle;

FIG. 3 is a side elevation of a portion of the subject conformed handle former, showing the feeding, separation and severance provisions for the masking element;

FIG. 7 is a schematic side elevation in partial section of the adhesive suppressant applicator portion of another embodiment;

FIG. 8 is a schematic side elevation in partial section of a liquid suppressant applicator tank; and FIG. 9 is a section taken at 9—9 of FIG. 8.

Referring to FIGS. 3 and 4, and more particularly to FIG. 5 the portable conformed handle making and attaching device 10 comprises a laterally off-set chassis plate 12 having a first spool carrier 14 and a second spool carrier 16 cantilevered therefrom. The spool carrier 14 has a spindle 18 extending in cantilevered relation therefrom. The spindle 18 carries a spool 20 for a roll 22 of pressure sensitive tape 24 thereon. An adjustable friction plate bears against a hub portion of spool 20, to brake the rotation thereof and create tension.

Figure 4:
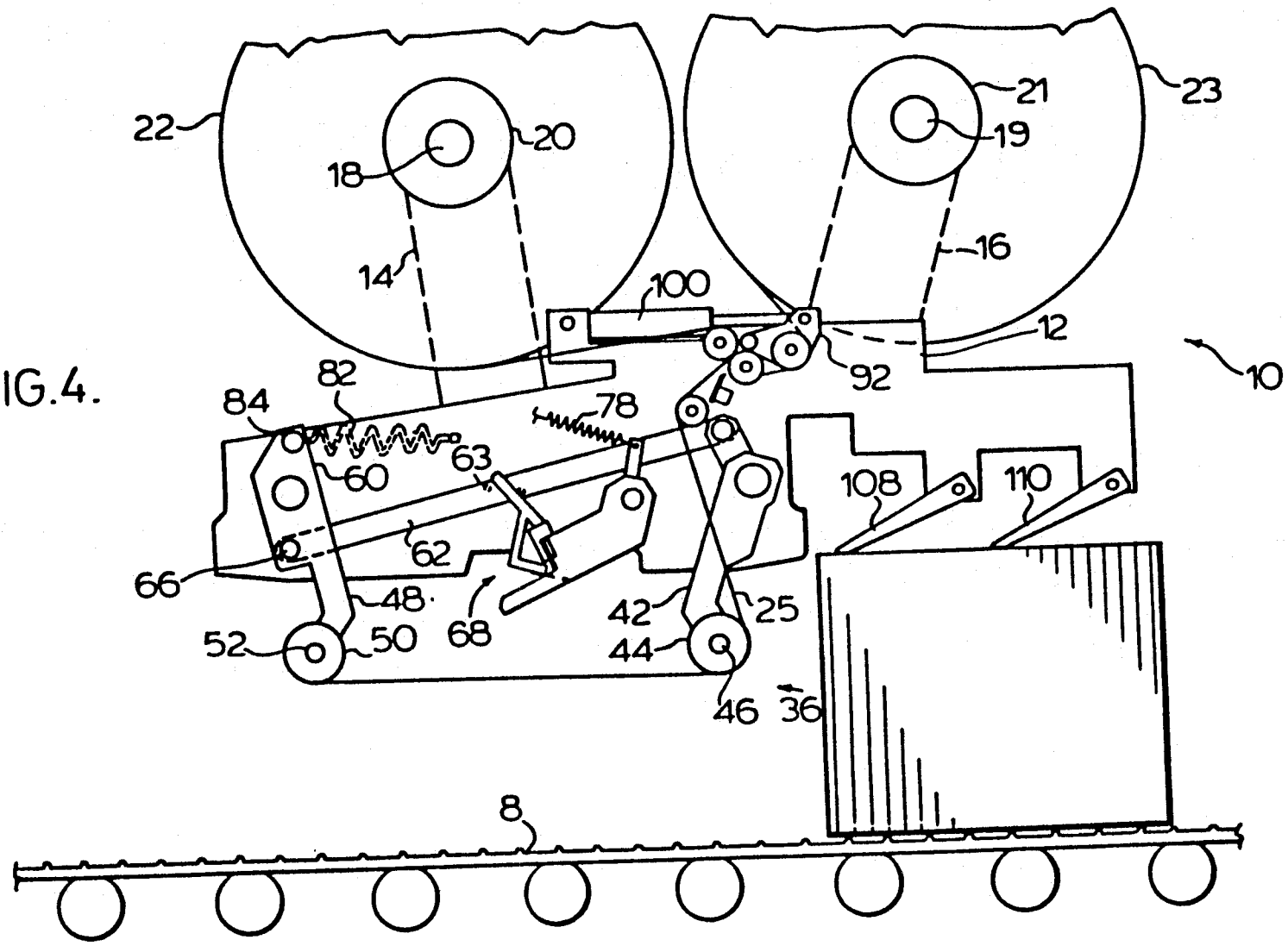
FIG. 4 is a schematic side elevation of the subject conformed handle former and applicator, in working relation with a conveyor, having a product thereon for application of a handle thereto.

The spool carrier 16 has a spindle 19 cantilevered therefrom. The spindle 19 carries a spool 21 for a roll 23, generally comprising a clear blanking ribbon or laminate 26.

Alternatively, the roll 23 can comprise a roll of pressure sensitive tape similar to roll 22 or other suitable material.

In general the ribbon or laminate 26 is marginally wider than tape 24, to allow for slight misalignments in use when brought into blanking relation with the adhesive face 28 of tape 24, and to accomodate any "bleed" of adhesive from the face 28. It is advantageous if the blanking element 26 is somewhat elastic, similar to tape 24.

The tape 24 is threaded about guide rolls 30, and 32 and makes adherent contact with roll 34.

A tape applying and severing means 36 is mounted on chassis plate 40, secured to chassis plate 12.

A first arm 42 has a soft surfaced presser roller 44 rotatably mounted on cantilevered spindle 46.

A second arm 48 has a soft surfaced presser roller 50 rotatably mounted on cantilevered spindle 52.

The first arm 42 is pivotally mounted on spindle 54 in cantilevered relation with the chassis plate 40, the arm 42 having an extension portion 56 extending therefrom.

The second arm 48 is pivotally mounted on spindle 58 in cantilevered relation with the chassis plate 40, the arm 48 having an overhung portion thereon.

A synchronizing rod 62 has the opposite ends thereof, interconnecting arms 48 and 42, mounted on spindles 64, 66 respectively. Spindle 64 is carried by extension portion 56 of arm 42. Spindle 66 connects arm 62 pivotally to arm 48, being located intermediate the spindles 52 and 58 thereof. In use, upward retraction of roller 44 produces automatic retraction of roller 50, by way of synchronizing rod 62, and vice versa.

A severing knife assembly 68 is pivotally supported on spindle 70 from chassis plate 40. The assembly 68 has a laterally offset depending extended shoe portion 72, to contact the box top to one side of the tape path. The assembly 68 includes a knife guard 74 and knife blade 76.

Arm extension 73 has a tension spring 78 secured thereto. The remote end of spring 78 is anchored by pin 80 to the chassis plate 40. Spring 78 loads the assembly 68 resiliently downwardly, pivoting about spindle 70.

A tension spring 82 secured by pin 84 to arm portion 60 of the arm 48, has the remote end thereof secured to threaded adjusting rod 84, by means of which the residual tension in spring 82 can be adjusted. The spring 82 applies a resilient downward loading to rolls 44 and 50.

The blanking ribbon 26 is dispensed by ribbon dispensing means 90. The ribbon dispensing means 90 comprises a pivot plate 92, pivotally mounted on pivot pin 94, the pin 94 also supporting a first ribbon guide roll 96 for rotation thereabout. A ribbon second guide roll 98 (FIG. 3) is rotatably mounted on pin 101, the pin 101 being cantilevered from pivot plate 92.

A presser roll 102 is rotatably mounted adjacent thereto, being also rotatably carried by pivot plate 92. An actuator cylinder 100 is pivotally mounted at 103 and pivotally connected at 104 to plate 92. The cylinder 100 is a double acting air actuated cylinder, shown in an extended condition.

Actuation of cylinder actuator 100 in a contracting sense pivots the pivot plate 92 anti-clockwise about pivot pin 94, displacing rolls 98 and 102 downwardly, away from guide roll 30.

A ribbon knife chassis 106 is located adjacent roll 98, being fixedly mounted on backing plate 12.

Actuation of cylinder actuator 100 is effected by arms 108, 110.

The handle making and attaching device 10 is used in conjunction with a conveyor 8, the device 10 being mounted at an optimum height above conveyor 8, in relation to the product or range of products to be handled for passage of product therepast.

It will of course be understood that instead of pressure-sensitive tape an adhesive may be applied by suitable rollers.

In use, before commencement of operation the device 10 is set up, in the manner illustrated.

The adhesive tape 24 is fed from roll 22 about guide rolls 30, 34 so as to leave a tongue portion 25 depending therebelow.

Between rolls 32 and 34 the ribbon 26 is in adhering relation with the adhesive surface 28 of tape 24. The ribbon 26 extends between guide roll 98 and presser roll 102, in adhering relation with the adjoining surface 28 of tape 24.

On passage of any product, of a range of product sizes and shapes beneath arms 108, 110 into contacting relation with roller 44 and the tongue 25 of tape 24, the arm 42 pivots upwardly over the front face of the box product, drawing the roll 44 in upward wiping relation over tape 24, to secure the initial portion 25 thereof as an attachment tab portion in adhering relation to the front or leading face of the product.

As the roller 44 is displaced upwardly, so the synchronizing bar 62 raises arm 48 and roller 50 upwardly.

Forward travel of the product towards shoe 72 draws the tape 24 and its attached masking portion 26 in tensioned, non adhering flush lying relation along the top of the product.

As the rear face of the product passes lever 110, which is downwardly spring loaded, the lever 110 is freed from the upward restraint provided by the product, and pivots downwardly, thereby admitting compressed air to actuator 100, in a contracting sense. The actuator 100 pivots plate 92 anti-clockwise, downwardly, so that guide roll 98 withdraws downwardly, and presser roll 102 serving as a separating means displaces the ribbon 26 downwardly in separating relation from the tape adhesive face 28, and forcing the ribbon 26 into severing relation with knife 106, due to ongoing motion of the downstream portion of the ribbon 26.

As the product proceeds further, the lever 108 is free to drop down, thereby actuating the associated switch and admitting air to cylinder 100 in extending relation therewith.

This reverses the motion of plate 92 and snaps the roller 98 upwardly towards guide roll 30, thereby re-adhering the ribbon 26 to the surface 28 of tape 24. In the meantime, a double tab length of tape 24 has been drawn off, and now extends intermediate the severed end of ribbon 26.

As the product passes beyond shoe 72, the knife assembly 68 drops downwardly, and as the roll 44 is still held upwardly in a retracted position, the knife 76 severs the tensioned tape 24. The roller 50 meanwhile has been pressing the combined tape 24 and masking ribbon 26 along the top of the product. As the product trailing edge passes roll 50, the spring 82 drives roll 50 downwardly across the rear (trailing) face of the product, thereby securing the trailing unmasked tab portion of tape 24 in pressure adhering relation to the product.

The succeeding unmasked portion of tape 24 depends as tongue 25, in prepared relation as the leading attachment handle tab for the next product to be treated.

The foregoing operation is facilitated by a brake blade 112 which is urged by spring 114 to retain ribbon 26 in severed relation to the surface of roller 96.

The adoption of soft faced rollers 44, 50 tends to compensate for any flexibility of the product surfaces, to promote effective tape adhesion thereto.

While the present invention has been described with reference to specific embodiments it will of course be understood that alternative embodiments and modifications may be made without departing from the spirit of the invention defined in the appended claims.

Figure 5:
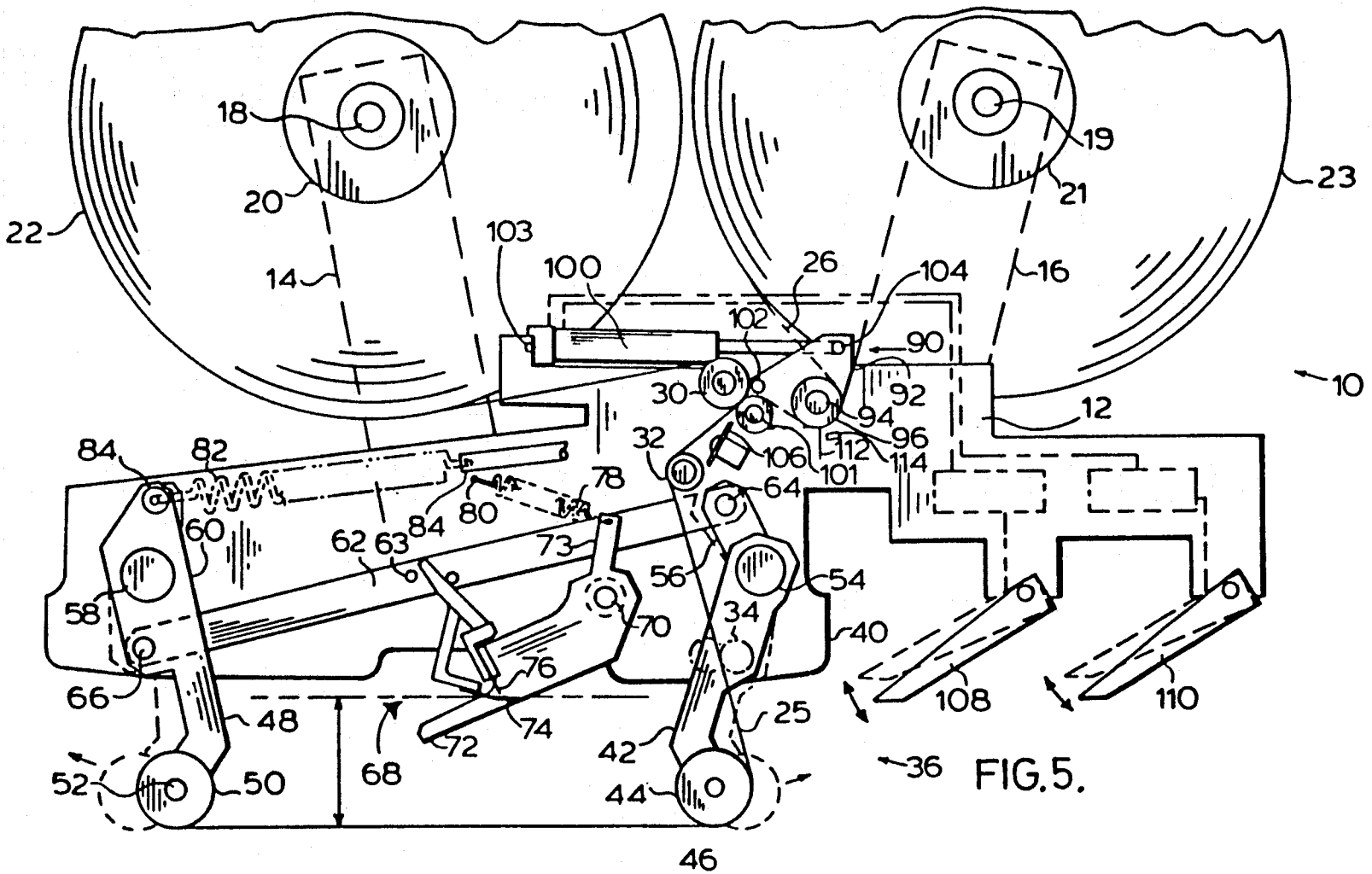
FIG. 5 is an enlarged detail of the subject conformed handle former.
Figure 6:
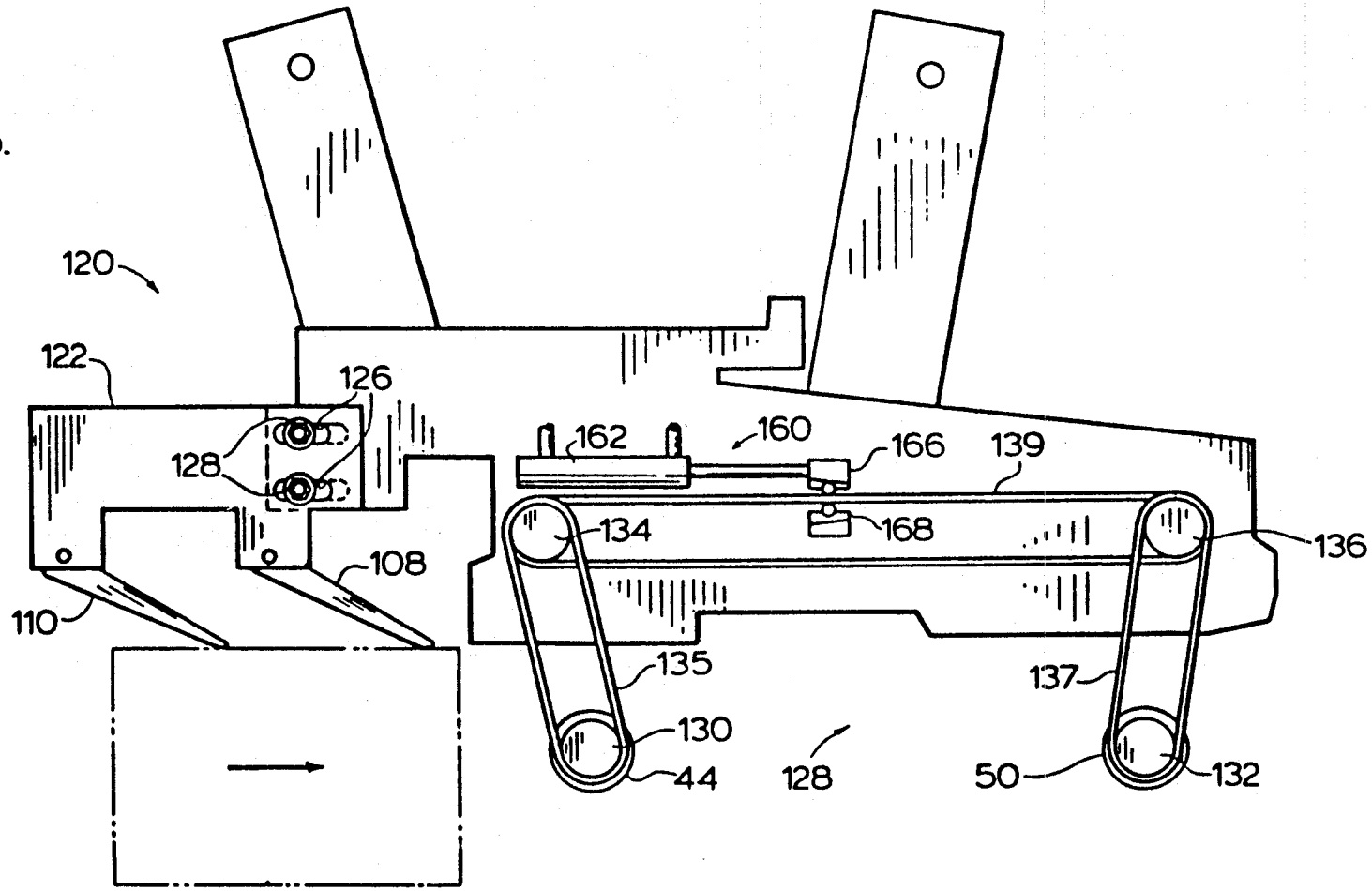
FIG. 6 is a side view of a portion of the looped handle former and applicator, corresponding to FIG. 5, as viewed from the rear.

Referring to FIG. 6, wherein the elements correspond generally with those of FIGS. 1 through 5, but viewed from the back of the machine the looped handle mechanism, 120 is provided with an adjustable frame portion 122, permitting the position of arms 108, 110 to be adjusted, relative to the other portions of mechanism 120, in an upstream or a downstream direction. Thus the slots 126 and securing bolts 128 permit selective relative adjustment to arms 108, 110 in an upstream or downstream direction. In use, movement of arms 108, 110 rightwardly, in FIG. 6, in the downstream direction extends the length of the handle beyond the length of the product, by delaying the operation of the cylinder actuator 100. The rollers 44, 50 are interconnected by a rotatable transmission 129, comprising pulleys 130, 132 and double pulleys 134, 136, and belts 135, 137, 139 connected therebetween to serve as a synchronizing means between the rollers 44 and 50 whereby rotation of roller 44 produces rotation of roller 50, in the same sense, and vice versa.

The transmission 129 is connected by double pulley 136 and belts 137, 139 with the rollers 44, 50, and a double acting pneumatic linear actuator 160.

In use the front attachment tab 25 of tape 24 is adhered to the front of the product, by the action of roller 44 and the tape 24 and attached ribbon 26 drawn along the top of the package. When the front of the product approaches the downstream roller 50, so that both rollers 44 and 50 rest on the surface of the tape, on top of the product, the air supply to actuator 162 is opened, causing the actuator 162 to contract. This contraction of actuator 162 causes the clutching action of rollers 166, 168 to engage the belt 139, which is then accelerated in its rotation, to draw off more tape and ribbon and extend the handle in length. Finally, the adherent rear tab of tape 24 is pressed in adhering relation by downstream roller 50 to the rear of the product.

Thus, in FIG. 6 a driving means for a free loop generating mechanism is shown, having the drive means 160 for advancing the free loop.

In the drive means 160, which functions in cooperation with belt 139 of transmission 129 a pair of opposed rollers 166, 168 are in neutral facing relation, having the belt 139 in sandwiched relation therebetween. The rollers 166, 168 are supported on tapered surfaces whereby displacement of rod 164 in a first direction (rightwardly, as viewed in FIG. 6) in extension of actuator 162 results in free-rolling rotation of rollers 166, 168.

Displacement of belt 139 leftwardly in the same relative sense produces free rolling of the rollers 166, 168.

Displacement of rod 164 in a second, opposite direction locks up the rollers 166, 168 against rotation, thereby seizing the belt 139 in gripping relation, for leftward linear displacement by the actuator 162.

Drive means 160 may be actuated by a pair of arms 108', 110' similar to drop arms 108, 110, in controlling relation with a pair of air admission valves, to drive the cylinder 162, whereby the rollers 44 and 50 are rotated to displace the handle free loop L in the desired direction, downstream.

In the illustrated control arrangement, the arms 108', 110' located intermediate rolls 44 and 50, and activated by the product leading edge, subsequent to attachment of the tape tongue portion 25 to the product, energizes actuator 162, thereby causing rotation of rollers 44, 50, such that roller 44, the upstream roller, feeds the tape 24 and ribbon 26 in a downstream direction, at a rate exceeding the passage rate of the product, so as to form a forwardly located handle free loop L.

By selective control of the stroke of actuator 162 the length of the free loop L can be controlled.

Referring to FIG. 7, there is shown a suppressant fluid applicator 210 mounted on pivot plate 92. Actuator cylinder 100 is pivotally mounted a 102 and pivotally connected at 104 to plate 92. The cylinder 100 is a double acting air actuated cylinder, illustrated in an extended condition.

The applicator 210 illustrated in FIG. 7 utilizes a fluid in the form of a powder, by way of a talc or the like, while the applicator 220 illustrated in FIGS. 8 and 9 utilizes a liquid base suppressant. 25 An applicator belt 222 mounted over guide pulleys 96', 98', 224, 226, 228 has a lower loose loop portion dipping downwardly within a suppressant fluid container. In the FIG. 7 embodiment the container 230 contains a fluent powder 232. The angle of inclination of container 230 is such that due to the angle of recline of the powder 232, upon actuation of actuator 100, to terminate contact of belt 222 with tape 24 the container 230 is displaced anticlockwise. This displacement increases the angle of inclination of powder 232 beyond its natural angle of recline. Also, the bottom wall 234 is displaced rightwardly away from the free loop of belt 222 to facilitate downward flow of the powder 232, to the bottom corner of container 230.

Upon expansion of actuator 100 the belt 222 is again brought upwardly into contacting relation with the tape 24, in driven relation therewith, to bring the layer of suppressant fluid powder into masking, adhering contact with the adhesive face of tape 24. At the same time, the angular position of container 230 is modified to the position shown in FIG. 7. It will be understood that the feed of powder to belt 222 is responsive to the rate of utilization of the suppressant powder. The outer surface of belt 222 has an applicator surface, such as open cell polyurethane, to contain and readily release the suppressant powder 232 in adhering masking relation with selected portions of tape 24.

Actuation of cylinder 100 is substantially the same as for the blanking tape embodiments illustrates in FIGS. 3-5.

Referring to FIGS. 8 and 9, there is shown an applicator 220 for liquid or semi-liquid suppressant, having a dispensing tank 240, having a reservoir 242 in restricted flow connection therewith. A communicating aperture 244 becomes uncovered, on tilting of the reservoir 242 under the action of actuator 100, in the fashion described with reference to the FIG. 7 embodiment. The change in orientation of the liquid surface is shown chain dotted at 250.

What is claimed:

1. A readily hand portable tape dispensing apparatus for use in combination with product conveying means, for dispensing a selected length of tape on to a product, comprising:

first tape dispensing means for dispensing said selected length of a first tape on to said product, first and third portions of the tape being adherably securable to respective surfaces of the product;

second dispensing means for dispensing masking element means in positioned adherent relation to a second portion of said first tape located between said first and third tape portions;

means for attaching said masking element to said second portion of said first tape, said attaching means comprising separation means for displacing the downstream end of said masking element means from said first tape, in separated relation therefrom; and knife means for severing said separated masking element means downstream of said separation means on passage thereof past said knife means;

said apparatus further including an upstream roller locking in the path of said product, for adhering said first tape first portion to a leading portion of said product, a downstream roller for adhering said third portion of said first tape to a succeeding portion of said product, and actuator means for electively rotating said upstream roller in loop forming relation with said tape and said masking element means.

2. The apparatus as set forth in claim 1, including an upstream roller locking in the path of said product, for adhering said first tape first portion to a leading portion of said product, a downstream roller for adhering said third portion of said first tape to a succeeding portion of said product, and synchronizing means interconnecting said upstream and said downstream rollers, to substantially synchronize their rotation.

3. The apparatus as set forth in claim 1 including control means in controlling relation with said separation means.

4. The apparatus as set forth in claim 3 said control means including a first switch means positioned in a first restrained condition during passage of said product in contact therewith, and moveable to a second, non-restrained position on passage of said product therepast, to actuate said separation means, in separating relation of said masking means from said tape.

5. The apparatus as set forth in claim 4 said control means including a second switch means positioned in a first, restrained condition during passage of said product in contact therewith, and moveable to a second, non-restrained position on passage of said product therepast, to reverse said separating means and reattach said masking element to said tape in adhering relation therewith.

6. The apparatus as set forth in claim 1, including adjustable control means in controlling relation with said separation means; said adjustable control means permitting adjustment of the length of said intermediate, second tape portion.

7. The apparatus as set forth in claim 6, including loop forming means, for forming a loop of said tape, in predetermined positioned relation relative to the length of said product.

8. The apparatus as set forth in claim 3, including loop forming means for forming an untensioned free loop of said masking element in adherent relation with said tape second portion.

9. The apparatus as set forth in claim 8, including control means actuable by passage of said product therepast, for positioning said free loop in predetermined position relation relative to the product.

10. A hand portable tape dispensing apparatus for use in combination with product conveying means, for dispensing a selected length of tape on to a product, comprising:

first tape dispensing means for dispensing said selected length of tape on to said product, first and third portions of the tape being adherably securable to respective surfaces of the product; and container means to contain fluent masking material to serve as a masking element, and masking element applicator means for dispensing applying and said fluent masking element material in adherent relation to a second portion of said tape, located intermediate said first and said third tape portions.

11. The apparatus as set forth in claim 1, said container means containing fluent powder, said masking element applicator means including belt means for applying said powder to said tape.

12. The apparatus as set forth in claim 1, said fluent material comprising a liquid; said applicator means including belt means to apply said liquid to said tape in deactivating relation with the adhesive of the tape.

* * * * *